362-110 SR
10/15/85 XR 4,547,837

United States Patent [19]

Bennett

[11] Patent Number: 4,547,837

[45] Date of Patent: Oct. 15, 1985

[54] TRACER LITE

[76] Inventor: Tommy N. Bennett, 2605 W. 19th, Plainview, Tex. 79072

[21] Appl. No.: 538,485

[22] Filed: Oct. 3, 1983

[51] Int. Cl.[4] ..... F21L 7/00

[52] U.S. Cl. ..... 362/186; 200/60; 362/110; 362/190; 362/191; 362/202; 362/203; 362/205; 362/208; 362/295; 362/311; 362/800

[58] Field of Search ..... 362/110, 186, 190, 191, 362/202, 203, 205, 208, 800, 295, 311; 200/60

[56] References Cited

U.S. PATENT DOCUMENTS

| | | | |
|---|---|---|---|
| 4,211,955 | 7/1980 | Ray | 362/800 |
| 4,226,163 | 10/1980 | Welcomer | 362/800 |
| 4,340,930 | 7/1982 | Carissimi | 362/110 |
| 4,408,261 | 10/1983 | Polakoff | 362/800 |

*Primary Examiner*—Stephen J. Lechert, Jr.

[57] ABSTRACT

A self contained light source consisting of a metal cylinder, preferably aluminum, encasing a battery threaded into one end of the aluminum cylinder there being a non conducting insulator which is manufactured to fit into bore of a commercial transparent archers nock. Located in hollow bore of said commercial nock there being a L.E.D. which is energized by screwing nock assembly into aluminum cylinder there by completing electrical circuit. The L.E.D. is selected to impose the proper current demand on the battery, which by its size becomes self limiting and is unable to burn out the L.E.D., there by eliminating all other electrical voltage controlling devices. The above described components form a unit assembly which may be glued into any commercial tubular arrow with minor modifications to the arrow.

5 Claims, 3 Drawing Figures

TRACER LITE

BACKGROUND OF THE INVENTION

There has long existed a need for an archers arrow attachment which would enable a night-time hunter to shoot several shots at moving game and be able to locate arrows which have not struck target. One attempt to satisfy this need was patented by John M. Ratkovich in June 1972, U.S. Pat. No. 3,790,948, and embodied the use of a radio transmitter. Another patent was obtained by Fernando Troncoso Jr. in January 1974, U.S. Pat. No. 3,865,374. The Troncoso patent described the use of a colored material affixed to the nock end of the arrow to improve visual location of the arrow. Said colored material does not effect arrow flight. A third patent was issued to Sam Carissimi Aug. 29, 1980, U.S. Pat. No. 4,340,930, describing the use of a lamp and battery along with a switch means and electrical circuits located within an archers arrow. This patent obtained by Carissimi is similar to our invention, however it falls short of the necessary requirements to provide a dependable arrow locating device. The main objections to Mr. Carissimi's invention are:

1. To many parts and too complicated, which makes it economically not feasible to manufacture.
2. Switch means as shown in his drawing FIGS. 2 and 3 lends itself to being operated by impact of arrow on target, or if operated inversely it could be switched by brushing or sliding against rocks or other obstacles found in a hunting environment.
3. The battery as represented in his drawings could be dislodged from its sleeve upon impact of arrow, resulting in an unreliable electrical circuit.

REFERENCES CITED

U.S. Patent Documents

U.S. Pat. No. 4,340,930, 8/1980, Carissimi, 182/491
U.S. Pat. No. 3,790,948, 6/1972, Ratkovich, 261/705
U.S. Pat. No. 3,865,374, 1/1974, Troncoso, 435/516

SUMMARY OF THE INVENTION

Our invention is to fulfill the need of an attachment that can easily be installed into most commercially available tubular archers arrows. This attachment is a self contained light source, battery and rotary switch means. The light source is a L.E.D. located inside of a transparent archers nock.

The principal improvements of our invention over the prior art are a greatly simplified electrical circuit where by we have eliminated all current limiting devices between the light source and battery. This results in a much lighter assembly which has less effect on arrow accuracy. We have also made major improvements in the switch means which result in a more reliable electrical circuit. By using a L.E.D. instead of a lamp we have eliminated the lamp filament which would have a very short life when subjected to the impact encountered in the exercise of normal archery activities.

A further benefit derived from the use of our attachment is the ability to use a commercial tubular archers arrow which would be more economical than a special arrow such as is required with the Carissimi assembly. Since our attachment is retained by a heat releasing glue or epoxy, it can easily be removed and reinstalled in another arrow if the original arrow should become damage beyond repair.

THE DRAWING

DETAILED DESCRIPTION OF AN EMBODIMENT OF THE INVENTION

Figure 1:
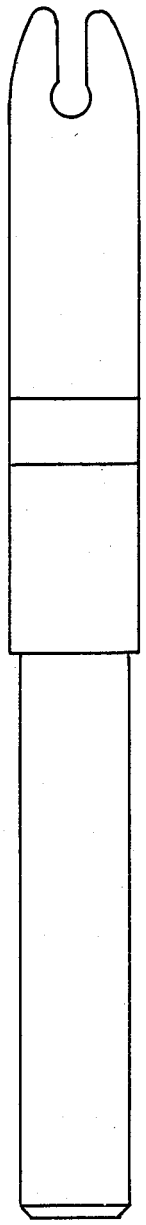
FIG. 1 is a full size side view of our attachment.
Figure 2:
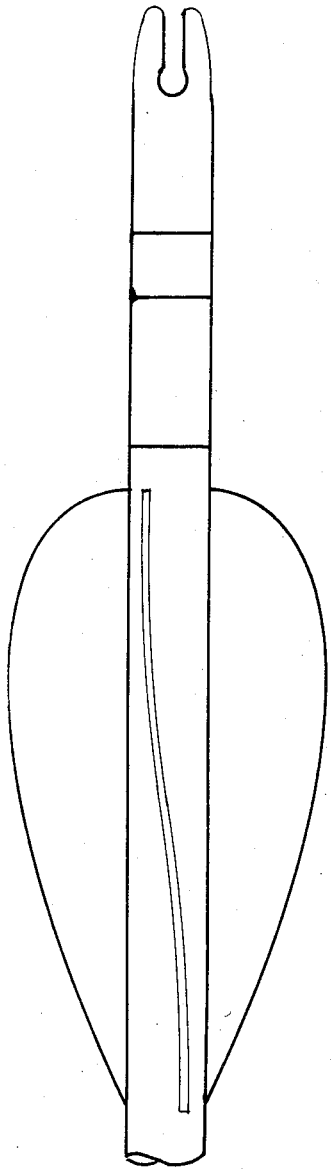
FIG. 2 is a side view of our attachment as it is envisioned installed in an archers arrow.
Figure 3:
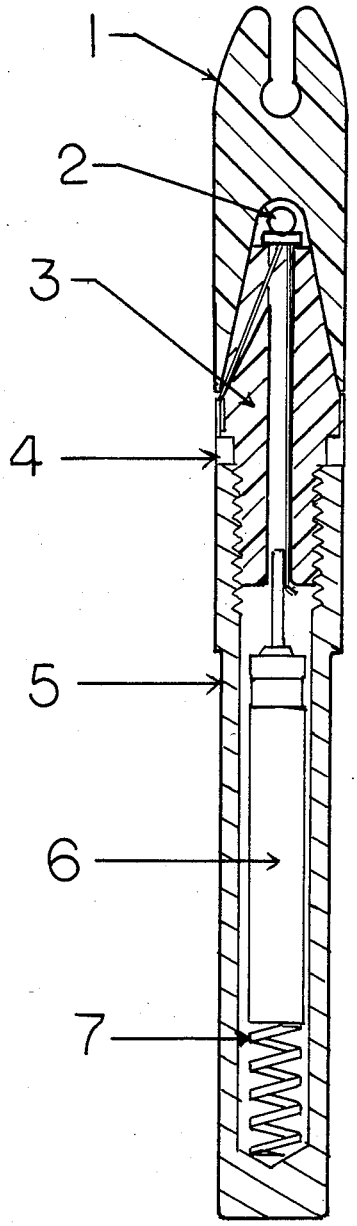
FIG. 3 is a cross section view showing numbered components in our attachment.

As are demonstrated by the drawing FIG. 3 my attachment embodies the use of a light emitting diode #2, hereafter referred to as L.E.D., located inside of a commercial transparent archers nock #1. This L.E.D. #2 with its positive and negative electrical leads, is inserted into an insulating screw #3 with one electrical lead extending through a small hole traversing the center line of said insulating screw. The other electrical lead being located in a slot adjacent to the outer surface of said insulating screw #3 and establishing positive contact with a metallic contact sleeve #4, said sleeve being circular around insulating screw #3 and located at the central termination of threads on the insulating screw #3. The above described sub-assembly is completed when the transparent nock #1 is glued onto said insulating screw #3 there by encasing the L.E.D. #2 and its electrical leads, and forming a bond capable of resisting impact and environmental conditions encountered in the exercise of normal archery activities.

The remainder of the invention consists of a metal cylinder #5 with its bore being partially threaded of sufficient diameter and length to accommodate a small elongated battery #6 and a spring #7; said spring being located between bottom of metal cylinder #5 and said battery. The purpose of said spring #7 is to maintain battery terminal against the L.E.D. lead central of insulating screw #3, and to exert a friction causing load, preventing the unscrewing of insulating screw from metal cylinder due to vibration or impact.

The electrical circuit is completed by a rotational switch operated by screwing the nock and L.E.D. assembly into the battery holding cylinder #5. The circuit is broken by simply "backing off" the threaded joint about one half turn.

What is claimed is:

1. A light producing attachment applicable to the nock end of a tubular archer arrow manufactured to commercial tolerances whereby said attachment may be substituted into the bore of said arrow in lieu of the commercial nock comprising in combination a cylinder in threaded communication with a commercial archer's nock said cylinder closed at one end and internally threaded at the other end and having a spring and battery therein, said archer's nock encasing a light emitting diode and being retained on an externally threaded nonconductive plastic support said threaded support having an opening therethrough for receiving an electrical lead.

2. The combination of claim 1 wherein said spring supports said battery.

3. The combination of claim 2 wherein said spring has sufficient compressive force to maintain electrical contact after acted upon by external forces.

4. The combination of claim 1 having a rotational type switch.

5. The combination of claim 1 wherein the battery output does not exceed 25 milli amp current when in circuit with said light emitting diode.

* * * * *